United States Patent [19]

Exalto et al.

[11] 4,397,721

[45] Aug. 9, 1983

[54] PICKLING OF ALUMINUM

[75] Inventors: Robertus Exalto, Amsterdam; Adriaan Kwakernaak, Aalsmeer, both of Netherlands

[73] Assignee: Fokker B.V., Schiphol-Oost, Netherlands

[21] Appl. No.: 347,974

[22] Filed: Feb. 11, 1982

[30] Foreign Application Priority Data

Feb. 12, 1982 [NL] Netherlands ..... 8100687

[51] Int. Cl.[3] ..... C25F 1/04

[52] U.S. Cl. ..... 204/144

[58] Field of Search ..... 204/144, 141.5

[56] References Cited

U.S. PATENT DOCUMENTS 4,042,475 8/1977 Bijlmer ..... 204/141.5

FOREIGN PATENT DOCUMENTS 756039 8/1956 United Kingdom ..... 204/144

*Primary Examiner*—T. M. Tufariello

*Attorney, Agent, or Firm*—Birch, Stewart, Kolasch & Birch

[57] ABSTRACT

Articles of aluminum are pickled by placing them as anodes into a sulfuric acid bath in the absence of chromic acid or bichromate and connecting them by a short-circuit connection to a carbon cathode placed in the same bath. The process also excludes the application of an anodic control voltage.

11 Claims, 2 Drawing Figures

PICKLING OF ALUMINUM

BACKGROUND OF THE INVENTION

This invention relates in general to the art of pickling aluminum articles and more in particular to a new process for pickling the same.

Articles of aluminum are often pickled at their surfaces in order to remove undesired oxide layers. This pickling operation may serve to obtain a more attractive appearance but also to give the pickled surface better characteristics for making adhesive joints or welded joints or to prepare it for an anodizing treatment.

The pickling operation is usually carried out by immersion of the article into an acid bath which comprises an oxidation agent in addition to a strong acid. Baths of chromic acid and sulfuric acid, as well as baths of sodium bichromate and sulfuric acid have been found to be most suitable for this purpose. However, although excellent results may be achieved in this way, the use of such pickling baths has become more and more objectionable in these days in view of the fact that the exhausted baths, due to their chromic acid or bichromate content, are most harmful to the environment and may, therefore, not be discharged to a sewer or to surface water in a direct way.

During a search for alternative pickling methods, it has been found that the same good results as in the past may be achieved with a pickling bath of sulfuric acid alone, provided that a slight anodic control voltage be applied to the bath. However, such anodic control voltage will complicate the method and will always cost energy. Therefore, it would be preferable if a method could be found wherein the control voltage is not needed.

The invention has for its object to provide a pickling process for aluminum articles wherein the use of chromic acid or bichromate in the pickling bath may be eliminated without any need for an anodic control voltage.

A further object is to provide a pickling process for aluminum articles wherein pickled articles of excellent quality can be obtained without the use of chromic acid or bichromate in the pickling bath and without any anodic control voltage.

In accordance with the present invention, these objects are realized by providing a pickling bath containing sulfuric acid without chromic acid or a bichromate oxidation agent. An aluminum article to be pickled is positioned as an anode into the pickling bath together with a carbon cathode, whereupon the anode and cathode are interconnected by an external short-circuit connection. An electric current of sufficient value will flow through the short-circuit connection and will initiate an electrochemical dissolution phenomena at the surface of the aluminum anode. As a result thereof, chemical pickling by the sulfuric acid bath is intensified in an efficient way. When the short-circuit connection is maintained for a time period of sufficient length, a complete pickling of the aluminum article may be achieved in spite of the fact that the pickling bath does not contain chromic acid or bichromate and in spite of the absence of an anodic control voltage.

According to the present invention, it is possible to obtain substantially equal results as with baths of chromic acid-sulfuric acid or bichromate-sulfuric acid. An important advantage is that chromic acid or bichromate are no longer required and this means that problems inherent to the disposal of exhausted baths are notably reduced. Another advantage is that an anodic control voltage is no longer required and this means that the apparatus may remain rather simple and that no energy supply is needed.

BRIEF DESCRIPTION OF THE DRAWINGS

The invention is illustrated by the accompanying drawings which are given only by way of example.

DESCRIPTION OF THE PREFERRED EMBODIMENT

Figure 1:
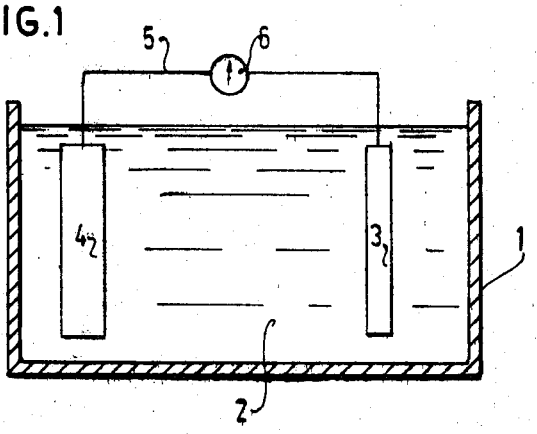
FIG. 1 shows schematically a preferred arrangement for carrying out the invention process and FIG. 2 shows a measuring arrangement.

A preferred embodiment for carrying out the invention process is shown in FIG. 1 of the drawings. This figure shows a pickling tank 1 containing a pickling bath 2 of sulfuric acid (without chromic acid or bichromate). Two electrodes, viz. an anode 3 and a cathode 4, have been immersed into bath 2, the anode 3 being an aluminum article to be pickled by the process and the cathode 4 being composed of carbon. Both electrodes have been interconnected by an external short-circuit connection 5 including an ammeter 6. The same parts can be discerned in the measuring arrangement of FIG. 2 but in that case, the anode 3 is coupled through a circuit 7 including a voltmeter 8 with a saturated calomel electrode 9 for continuous measurement of the anode potential.

Figure 2:
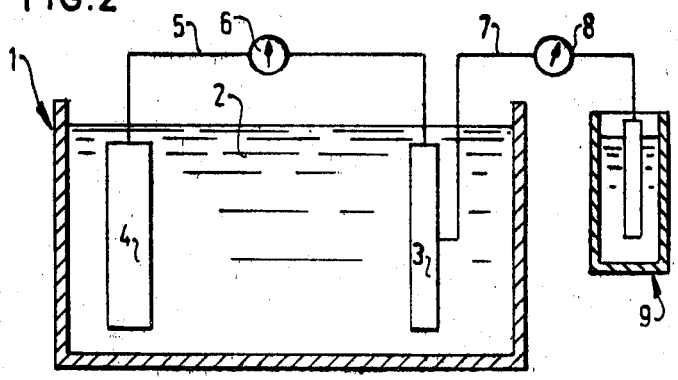

In the measuring arrangement of FIG. 2, supposing that the electrodes have been immersed into the bath and have been interconnected electrically by a short-circuit connection, the anode potential and the electric current through the circuit 6 are measured continuously in order to determine correct parameters for optimal operation. As soon as such parameters have been found, the arrangement of FIG. 1 is used for further operation and the values as found are used therein.

It should be noted that the process of the present invention and consequently the arrangements of FIGS. 1 and 2 are only meant for pickling of aluminum articles and not for an anodizing treatment thereof. Both pickling and anodizing will result in the removal of an undesired oxide layer from the surface of the aluminum articles and in the formation of a new oxide layer on that surface, but a newly formed oxide layer after pickling has about the same thickness as the undesired initial oxide layer (about 400 A) whereas a much thicker oxide layer (for instance of about 3 to 10 microns thickness) will result after an anodizing treatment due to the use of an external voltage.

The results of the pickling process may be expressed in various ways, e.g. by stating pickling rate and peel strength values. The pickling rate is an indication of the thickness of an oxide layer removed in the course of the pickling process and is expressed in $mg.dm^{-2}.h^{-1}$. The peel strength relates to a test wherein an adhesive layer is attached to the pickled surface and then peeled off.

The results of the pickling process may also be expressed by stating microstructure quality of the aluminum surface. Such microstructure may be ascertained by electronmicroscopic inspection of direct carbon replicas taken directly from the aluminum surface. Generally speaking, a surface of aluminum is only suitable for making adhesive joints if the microstructure of the surface shows microscopic pits of about 300 A in diameter. Should the pickling rate be too low, then residual oxide particles will still be present, and should the pickling rate be too high, then the etching pits will become too large.

Aluminum articles of any type may be pickled by the invention process. Articles of aluminum and aluminum alloys as well as articles of another metal coated with a layer of aluminum can be used. Such articles may be of any shape, e.g. sheet or tubular shape although sheets are preferred. A problem with tubular shapes is that the interior surface thereof may be shielded against action of the pickling bath and therefore, pickling of tubular shapes is less preferred.

The carbon cathode may have any suitable shape and composition as well. Athough only one carbon body has been shown in the drawings, it may be advantageous to have a cathode composed of four carbon bodies, each in one of the corners of the pickling tank 1, in order to make an efficient use of the total volume of bath 2 for current passage. Each carbon body may have been made in a conventional way, e.g. by compressing a mixture of carbon granules and binder with or without an internal reinforcement.

Bath 2, wherein the electrodes 3 and 4 are positioned may in principle only comprise sulfuric acid although many additives may be present in addition thereto in order to promote the electrochemical phenomena. The sulfuric acid concentration in the bath may vary between wide limits but concentrations of 100 to 300 gram/dm$^3$ of $H_2SO_4$ are preferred in most cases. Further, the bath will mostly be at an elevated temperature e.g. between 40° and 75° C.

When the electrodes are placed into the bath and the short-circuit connection is established, the electrochemical potential in the bath should have a sufficient value to cause the passage of an electric current through that bath. Quite generally, this value will be sufficient when an aluminum anode and a carbon cathode are used, but the actual value will depend from several facts such as the ratio of cathode to anode surface area, the temperature and sulfuric acid concentration of the bath, the nature of the aluminum article, and the like. Among these facts, the ratio between cathode and anode surface area is especially important because it has a strong influence on the electrochemical potential and consequently a strong influence on the pickling rate.

Account should be taken of the fact that a decrease in electrode potential in consequence of polarization is mostly occuring within a short period after the start of the pickling process. This polarization can be prevented from becoming too important by selecting a relatively low bath temperature and selecting a moderate bath concentration.

The nature of the aluminum article has only a small influence on the pickling process in most cases, although a small deposition of copper onto the cathode may occur during use of a copper-containing aluminum alloy.

During tests with aluminum articles of various types, it appeared that optimum pickling could be achieved with the following combination of conditions:

cathode/anode surface area ratio: 6
bath temperature: 40°, 50°, 60° C.
bath concentration: 100 g/dm$^3$ and with the following combination as well:

cathode/anode surface area ratio: 6
bath temperature: 40° C.
bath concentration: 200 g/dm$^3$ With these optimum pickling conditions, however, the pickling rate values were relatively small. Moreover, copper was easily deposited on the cathode surface when a copper-containing aluminum alloy was used. Therefore, the surface area ratio between cathode and anode had to be selected at a value substantially higher than 6 in order to obtain a reasonable pickling rate and to prevent copper deposits. Values up to 42 have been tested for this ratio in practice.

The time period should be sufficient to achieve proper pickling and will be 10–30 minutes in most cases.

The sulfuric acid bath may be used many times for pickling aluminum articles in accordance with the invention process. Nevertheless, its sulfuric acid concentration and bath temperature should be measured each time in order to allow an adjustment thereof.

The aluminum concentration of the bath should also be measured from time to time since small amounts of aluminum will always dissolve into the bath. Further, the strength of the current in the short circuit connection 5 should be measured regularly.

The pickling bath may be removed at an aluminum content of about 20 g/l. It is then neutralized, e.g. with lime, calcium hydroxide or caustic soda, and may thereafter be discarded. In view of the fact that the exhausted bath does not contain chromic acid or sodium bichromate, its disposal is easier than with exhausted chemical pickling baths of the prior art.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What we claim is:

1. A pickling process for aluminum articles, comprising the steps of:

(a) providing a pickling bath consisting essentially of sulfuric acid;

(b) positioning two electrodes, viz. an anode and a cathode, into said pickling bath, said anode comprising an aluminum article to be pickled and said cathode comprising at least one carbon body;

(c) interconnecting said anode and said cathode by means of an external short-circuit connection; and (d) maintaining said short-circuit connection during a period of time sufficient to cause complete pickling of said aluminum article.

2. The process as claimed in claim 1, wherein said article is an aluminum alloy article.

3. The process as claimed in claim 1, wherein said article is an article of a non-aluminum metal coated with a layer of aluminum.

4. The process as claimed in claim 1, wherein said cathode has a surface area exceeding the surface area of said anode.

5. The process of claim 1, wherein said cathode has a surface area of more than 6 times the surface area of said anode.

6. The process as claimed in claim 1, wherein said bath has a temperature of between 40° and 60° C. at a sulfuric acid concentration of about 100 g/dm$^3$ in said bath.

7. The process as claimed in claim 1, wherein said bath has a temperature of about 40° C. at a sulfuric acid concentration of about 200 g/dm$^3$ in said bath.

8. A pickling process for aluminum articles, comprising the steps of:

(a) providing a pickling bath consisting essentially of sulfuric acid in a concentration of about 100 g/l said bath having a temperature between 40° and 60° C.;

(b) positioning two electrodes, viz. an anode and a cathode, into said pickling bath, said anode comprising an aluminum article to be pickled and having a surface area ratio of about 6 to said cathode, and said cathode comprising at least one carbon body;

(c) interconnecting said anode and said cathode by means of an external short-circuit connection, and (d) maintaining said short-circuit connection during a period of time sufficient to achieve a complete pickling of said aluminum article.

9. The pickling process of claim 8, wherein said article is an aluminum alloy article.

10. A pickling process for aluminium articles, comprising the steps of:

(a) providing a pickling bath consisting essentially of sulfuric acid in a concentration of about 200 g/dm$^3$, said bath having a temperature of about 40° C.;

(b) positioning two elelctrodes, viz. an anode and a cathode, into said pickling bath, said anode comprising an aluminium article to be pickled and having a surface area ratio of more than 6 to said cathode, said cathode comprising at least one carbon body;

(c) interconnecting said anode and said cathode by means of an external short-circuit connection; and (d) maintaining said short-circuit connection during a period of time sufficient to achieve complete pickling of said aluminium article.

11. The process as claimed in claim 10, wherein said article is an aluminum alloy article.

* * * * *